US007523997B2

(12) United States Patent
Jalabert et al.

(10) Patent No.: US 7,523,997 B2
(45) Date of Patent: Apr. 28, 2009

(54) REMOVABLE ATTACHMENT FOR A ROCK BREAKER

(75) Inventors: Gilles Jalabert, Lyons (FR); Paul Valverde, Grenay (FR)

(73) Assignee: Montabert, Saint Priest (FR)

( * ) Notice: Subject to any disclaimer, the term of this patent is extended or adjusted under 35 U.S.C. 154(b) by 240 days.

(21) Appl. No.: 10/584,941

(22) PCT Filed: Feb. 10, 2005

(86) PCT No.: PCT/FR2005/000307

§ 371 (c)(1),
(2), (4) Date: Sep. 5, 2006

(87) PCT Pub. No.: WO2005/090693

PCT Pub. Date: Sep. 29, 2005

(65) Prior Publication Data

US 2008/0047171 A1 Feb. 28, 2008

(30) Foreign Application Priority Data

Feb. 18, 2004 (FR) ..... 04 01622

(51) Int. Cl.
*E02F 3/96* (2006.01)

(52) U.S. Cl. ..... 299/100

(58) Field of Classification Search ..... 299/100, 299/95, 64

See application file for complete search history.

(56) References Cited

U.S. PATENT DOCUMENTS

| | | | | |
|---|---|---|---|---|
| 3,997,068 | A | 12/1976 | Lock | |
| 4,070,772 | A * | 1/1978 | Motomura et al. | 37/403 |
| 4,602,821 | A * | 7/1986 | Schaeff | 299/67 |
| 5,507,051 | A * | 4/1996 | Mazon | 7/116 |

FOREIGN PATENT DOCUMENTS

| | | |
|---|---|---|
| EP | 0 717 154 | 6/1996 |
| JP | A 11-117344 | 4/1999 |
| JP | A 2003-213720 | 7/2003 |

* cited by examiner

*Primary Examiner*—John Kreck
(74) *Attorney, Agent, or Firm*—Oliff & Berridge, PLC

(57) ABSTRACT

The invention relates to a bucket-, claw-, scraper-blade- or compacting-type attachment (1) which is intended to be fitted at one end (18) of a rock breaker (15) comprising a tool (17). The inventive attachment comprises: (i) means (7, 8, 9, 12) enabling the correct positioning thereof in relation to the rock breaker and the tool; and (ii) means (13, 14, 20) for fixing same temporarily and removably to the end of the rock breaker, without dismantling the tool (17).

10 Claims, 5 Drawing Sheets

V
15
18
19
10
13
12
14-20
9
IV
IV
6
8
11
1
7
4
17
5
2
V 3
4
6
1
9
9
2
19
17
18
13
16
8
4

REMOVABLE ATTACHMENT FOR A ROCK BREAKER

BACKGROUND OF THE INVENTION

The present invention concerns a bucket-, claw-, scraper blade- or compacting-type attachment intended to be fitted to an arm of a machine to which a rock breaker is connected.

Hydraulic rock breakers comprising a tool are used during operations involving the destruction of surfacing or hard ground layers and for breaking blocks of rock or concrete during earthwork or demolition operations.

Use of such a machine causes extensive production of spoil, which hampers the destruction operation. This spoil must therefore be regularly removed or compacted. Soil overlying rock may also need to be removed before using the rock breaker.

DESCRIPTION OF THE PRIOR ART

For this reason, rock breaker usage implies regular implementation of one or more attachments, such as a spoil removal device or a compacting device. Generally, each attachment is mechanically fixed to the end of the articulated arm of a distinct earthwork machine, such as a mechanical or hydraulic excavator. However, only one earthwork machine can be used, on which a rock breaker fitted with a tool or a spoil removal device is fitted according to the operation in progress.

On currently known machines, when the articulated arm is fitted with a rock breaker and the spoil produced needs to be removed, the rock breaker has to be removed before installing the required spoil removal device. During removal, the rock breaker has to be disconnected from its supply circuit, which is generally hydraulic.

These fitting and dismantling operations involving the rock breaker or attachment required for usage are long and reduce significantly the availability of the carrier machine.

There are already a number of devices designed to curtail these dismantling and disconnection operations.

For example, document EP 0 717 154 describes a hydraulic rock breaker comprising a tool connected to one end of an articulated arm and on which is attached a spoil removal bucket, which can swivel and be retracted when the rock breaker is used. However, this bucket cannot be removed. A machine according to this document certainly allows fitting and dismantling of the bucket to be avoided, when the rock breaker is being used, but it nevertheless remains necessary to remove the tool, when the user wants to use the bucket. Furthermore, the presence of the bucket at the end of the articulated arm of the carrier machine during hydraulic rock breaker usage is detrimental to the unit handling capacity and reduces its use to limited areas because of the spatial requirement of the bucket.

SUMMARY OF THE INVENTION

The aim of the present invention is to overcome the previously stated drawbacks and, to this end, consists in a bucket-, claw-, scraper blade- or compacting-type attachment intended to be fitted to one end of a rock breaker equipped with a tool, characterized in that it comprises, on the one hand, means allowing it to be correctly positioned with respect to the rock breaker and its tool and, on the other hand, means allowing it to be temporarily fixed at the end of the rock breaker and to be removable without dismantling the tool.

When the operator of the machine wishes to use the attachment instead of the tool, he places the attachment at the end of the rock breaker, the means allowing the attachment to be positioned with respect to the tool providing a clearance, into which the tool can be inserted and located. Once positioning has been completed, fixing means allow the attachment to be locked in translation and in rotation. Tool disconnection is therefore unnecessary because of this and the attachment can be used even with the tool in place. This means that operations required for tool changing turn out to be greatly minimized and do not disrupt proper usage of the rock breaker.

Preferably, the attachment comprises a back wall with an external face fitted with a guide tube intended to be engaged on the tool. This tube is intended to receive the tool, which then plays the part of an upright providing reinforcement and support. Attachment stability is thereby increased.

Preferably again, the tube has an insertion end widened into the shape of a funnel. Tool insertion into the tube is much easier because of this.

Preferably, the insertion end is surmounted by a socket fitted with at least one positioning pin.

According to a first form of embodiment, the tube comprises two orifices facing each other, allowing a fixing key intended to be engaged in a recess in, or in a hole through, the tool.

According to another form of embodiment of this attachment, the means allowing it to be fixed include at least two fixing lugs mounted on the top wall of the attachment, each incorporating an eye, and through which a retaining bar can be inserted and fixed, passing over a collar or similar belonging to the rock breaker body.

According to yet another form of embodiment, this attachment comprises a top wall surmounted by a lock-bolt, which can pass alternately from a locked position, in which it is capable of locking a part of the rock breaker body, to an unlocked position, in which it is capable of releasing this body.

In this case, the attachment comprises advantageously elastic means tending to place automatically the lock-bolt in its locked position and a pressure cylinder or mechanism capable of acting on the lock-bolt to throw it into the open position. This allows the operator to connect and disconnect the attachment at distance without acting directly on it.

According to one form of embodiment, this attachment comprises elastic means tending to place automatically the lock-bolt in its locked position and a release mechanism comprising a plate, mounted to slide with respect to the top wall of the attachment and transversely to the axis of the tool, such that, in the locked position of the tool, one end of the plate bears on a cam-shaped surface of the lock-bolt and its other end bears on an inclined surface of a collar of the tool, and that during movement of the tool, its collar displaces the plate toward the lock-bolt, which causes the latter to pivot in an opening direction.

According to another characteristic of the invention, this attachment comprises means of rotational locking onto the rock breaker comprising a noncircular-shaped socket intended to co-operate by interlocking with a complementary surface of the bottom end of the rock breaker body.

The invention will be better understood through the following description referring to the appended schematic drawing representing several forms of embodiment of this attachment.

DESCRIPTION OF THE PREFERRED EMBODIMENTS

Figure 1:
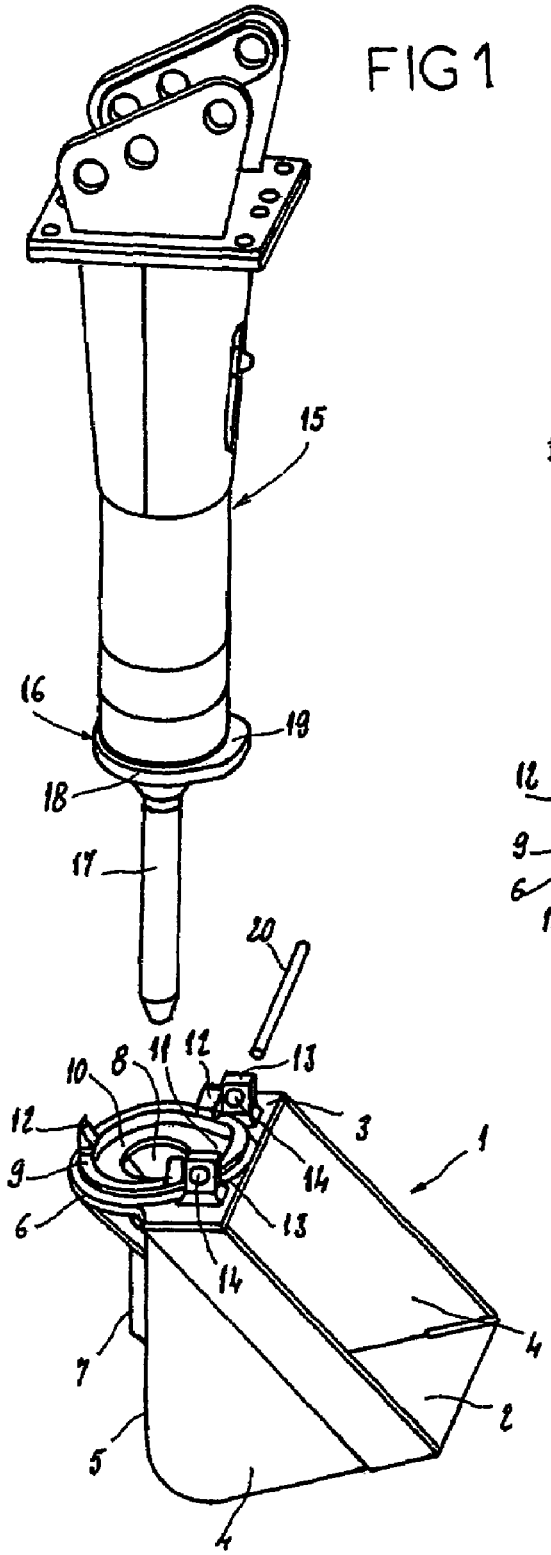
FIG. 1 is a perspective view of an attachment and a rock breaker seen in a removed position.
Figure 2:
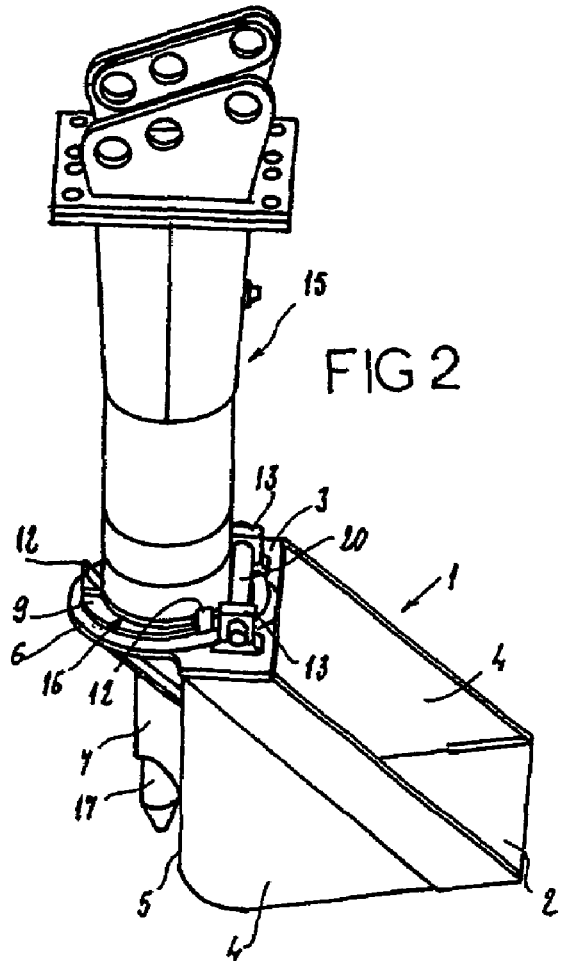
FIG. 2 is a perspective view of the attachment in FIG. 1 fixed to the rock breaker.
Figure 3:
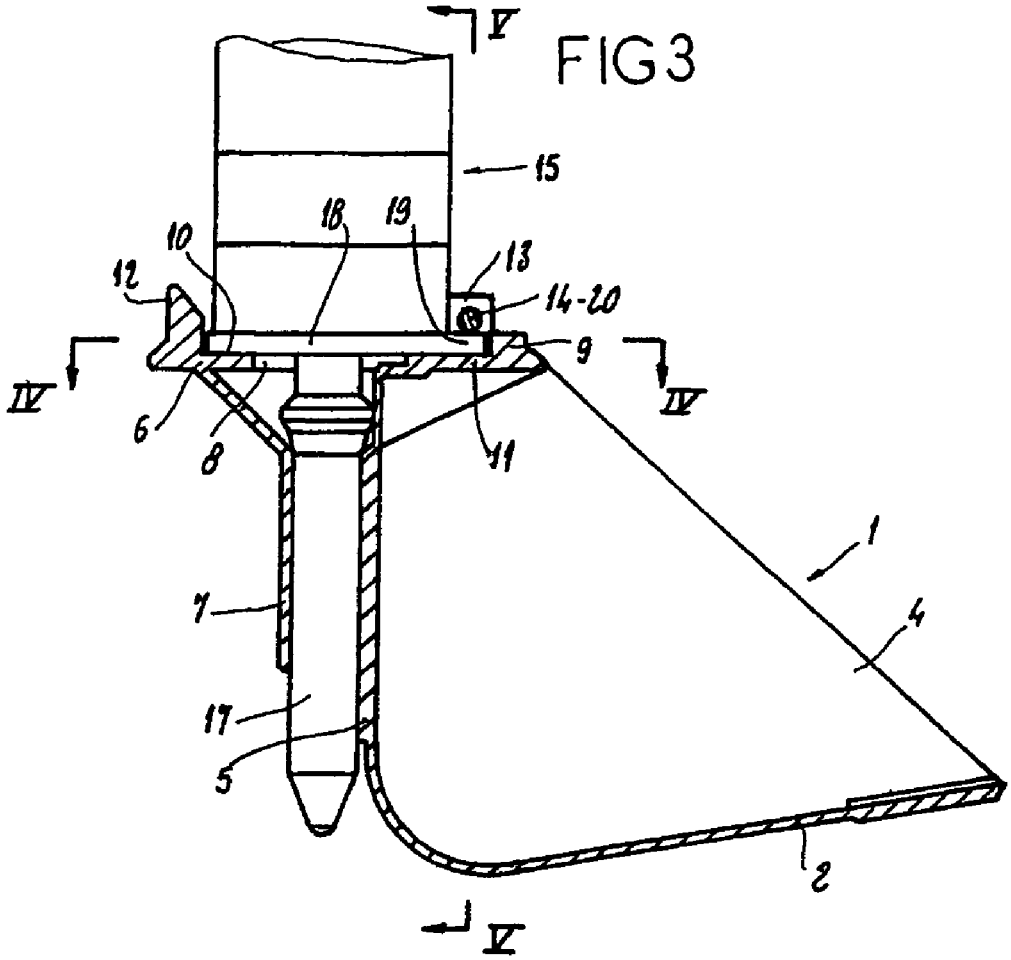
FIG. 3 is a partial view of a longitudinal cross section through the attachment and the earthmoving machine represented in FIG. 2.
Figure 4:
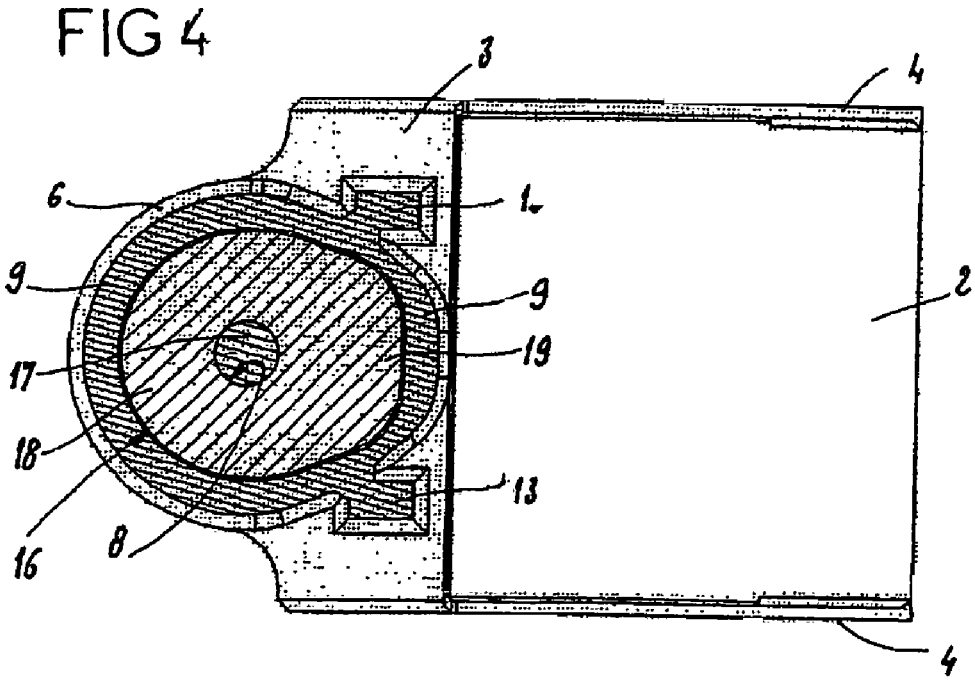
FIG. 4 is a cross-sectional view along transverse line IV-IV in FIG. 3.
Figure 5:
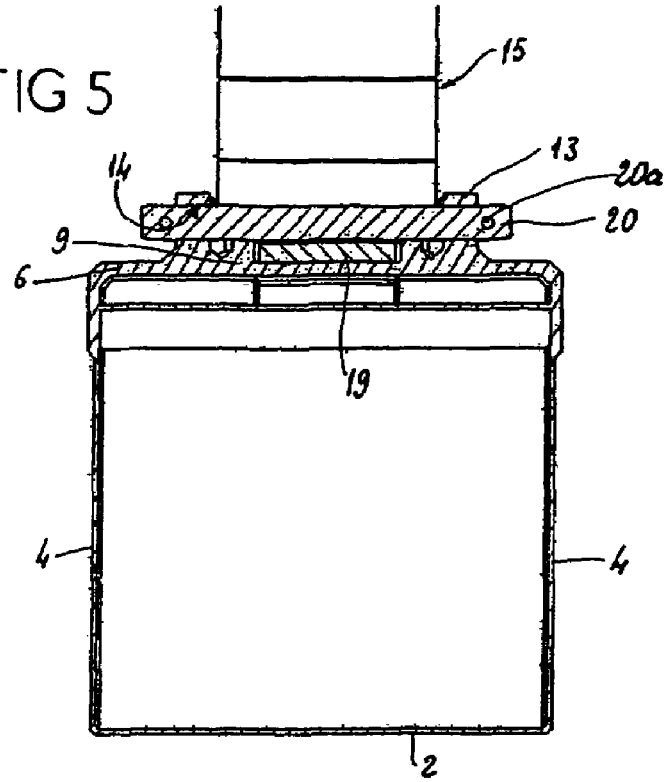
FIG. 5 is a cross-sectional view along line V-V in FIG. 3.

An attachment 1 according to the invention, such as the one represented in FIGS. 1 to 5, is a bucket-type device for removing spoil. As in all conventional buckets, the structure of this one comprises horizontal top and bottom walls 2 and 3 respectively, connected by two parallel side walls 4 and a back wall 5.

The bucket 1 also comprises both a horizontal socket 6 extending in prolongation of the top wall 3 toward the back of the bucket 1 and an essentially vertical tube 7 extending along the external face of the back wall 5. Moreover, the socket has an opening 8 of slightly larger cross-sectional area than the cross-sectional area of the tube 7 and this opening is located on the axis of the latter tube.

More precisely, the tube 7 has an insertion end widened into the shape of a funnel supporting the socket 6.

Moreover, the top face of the socket 6 has an essentially annular peripheral edge 9 delimiting an essentially ovoid bearing surface 10 with a noncircular extension 11 partially overhanging the top wall 3 of the bucket 1. Positioning pins 12 are positioned at regular intervals around the edge 9 and each has an inclined surface sloping toward the opening 8.

Outside the edge 9, the top wall 3 has two fixing lugs 13 directed upwards and positioned facing each other on each side of the bearing surface 10 at its extension 11. Each fixing lug 13 incorporates an eye 14, which emerges just above the edge 9 and which is located facing the eye 14 of the other fixing lug 13.

This bucket 1 is intended to equip a hydraulic rock breaker, partially represented in FIGS. 1 to 5, comprising a body 15 of essentially circular cross section and with an end 16 to which a tool 17 is connected. Moreover, the end 16 of the body 15 is provided with a collar 18 featuring, on the one hand, a cross section complementary to the bearing surface 10 of the bucket 1 and, on the other hand, a thickness essentially equal to the height of the edge 9. A part 19 of the collar 18 therefore projects from the body 15 because of the ovoid cross section of the collar 18.

A user wishing to connect the bucket 1 according to the invention to the end of the body 15 of the rock breaker proceeds in the following way.

The bucket 1 is positioned such that the tube 7 and the opening 8 are aligned with the tool 17. The latter tool is inserted through the opening 8, then into the tube 7, which plays the part of a slide keeping the bucket 1 stationary with respect to the axis of the body 15. The funnel formed by the insertion end of the tube 7 facilitates insertion of the tool 17 into the tube 7.

The bucket 1 is displaced in this way until the collar 18 is introduced within the edge 9 and comes into contact with the bearing surface 10, the projecting part 19 of the collar 18 then being in contact with the extension 11 of the bearing surface 10.

Positioned in this way, the bucket 1 can be fixed to the body 15. To perform this, a retaining bar 20 is inserted through the eyes 14 of the fixing lugs 13 then locked, for example using pins 20*a*. FIGS. 2 to 5 show the bucket 1 attached to the body 15 of the rock breaker in this way.

Since the cross sections of the collar 18 and the bearing surface 10 are noncircular, the bucket 1 cannot rotate about the axis of the body 15 because the projecting part 19 of the collar 18 would come up against the edge 9. Translation of the bucket 1 along the axis of the articulated arm 15 is also inhibited by the retaining bar 20, up against which the projecting part 19 of the collar 18 would come. The retaining bar 20 also prevents deviation of the bucket 1 with respect to the axis of the tool 17, when using this bucket 1. The tube 7 also inhibits such a deviation and allows the forces exerted in this direction on the retaining bar 20 and on the projecting part 19 of the collar 18 to be reduced.

When proceeding to remove the bucket 1, the pins are simply unfastened without tooling and the retaining bar 20 is then drawn out. Released in this way, the bucket can be slid along the axis of the tool 17 to extract it from the tube 7 and the socket 6.

It emerges from the description that operations for installing and removing the bucket 1 do not require removal of the tool 17.

Figure 6:
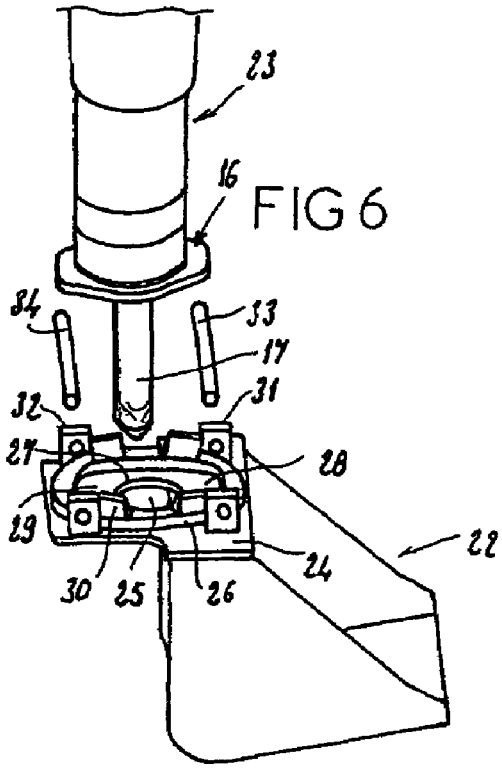
FIG. 6 is a perspective view of an attachment and a rock breaker according to a second embodiment of the invention, in a removed position.
Figure 7:
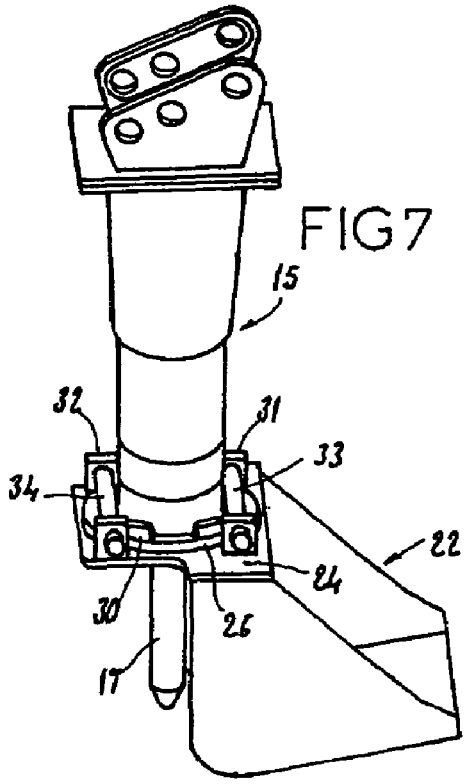
FIG. 7 is a perspective view of the attachment in FIG. 6 fixed to the rock breaker.

As represented in FIGS. 6 and 7, a collar with an oval cross section and two opposed projecting parts can be provided in order to better the forces distribute and to allow safer fixing of a bucket 22 on a rock breaker body 23.

The bucket 22 differs from the bucket 1 by the fact that it comprises a horizontal socket 24, which extends in prolongation of the top wall 3 toward the back of the bucket 22 and features an opening 25. More precisely, the top face of the socket 24 has a peripheral edge 26 delimiting an essentially oval bearing surface 27, complementary to the collar of the body 23, with a front end 28 and a rear end 29. Positioning teeth 30 are provided at regular intervals along the edge 26.

Furthermore, outside the edge 26, the socket 24 has a first pair of fixing lugs 31 and a second pair of fixing lugs 32; the lugs 31, 32 of each pair being positioned facing each other on each side of the bearing surface 27 at its front end 28 and rear end 29 respectively. Each fixing lug 31, 32 is provided with an eye, which emerges just above the edge 26 and is located facing the eye of the other fixing lug 31, 32 of the corresponding pair. The tube 7 located along the bucket is then no longer required.

Attachment of the bucket 22 is performed in the same way as for the bucket 1. The perforating tool 17 is inserted into the opening 25 until the collar is introduced within the edge 26 and is in contact with the bearing surface 27, the projecting parts of the collar then being in contact with the front end 28 and the rear end 29 of the bearing surface 27.

Positioned thus, the bucket 22 can be fixed to the body 23. To perform this, a retaining bar 33 is inserted through the eyes of the fixing lugs 31, then locked using pins. Similarly, a retaining bar 34 is inserted through the eyes of the fixing lugs 32, then also locked in this position.

Figure 8:
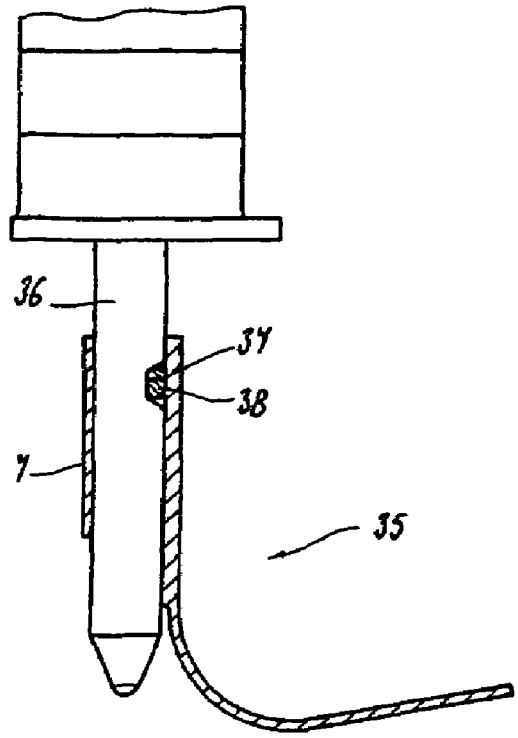
FIG. 8 is a schematic view of a longitudinal cross section through an attachment according to a third embodiment of the invention attached to a perforating tool.

FIG. 8 shows a bucket 35 adapted to a tool 36. This bucket 35 differs from the bucket 1 by the fact that it comprises neither a socket nor an insertion end and by the fact that the tube 7 comprises two orifices (not represented) facing each other. The tool 36 differs from the tool 17 only by the fact that it comprises a recess 37 intended for passing a fixing key 38.

When proceeding to fix the bucket 35 onto the tool 36, the tool 36 is simply inserted into the tube 7 until the recess 37 is aligned with the orifices in the tube 7. The key 38 is then successively inserted through a first orifice in the tube 7, the recess 37 and the second orifice in the tube 7, then it is locked in this position.

The key 38 locks the bucket 35 in both rotation and translation. Furthermore, the tube 7 stabilizes the bucket 35 and prevents any deviation of it with respect to the axis of the perforating tool 36.

Obviously, this fixing method can be combined with the other fixing methods described.

Figure 9:
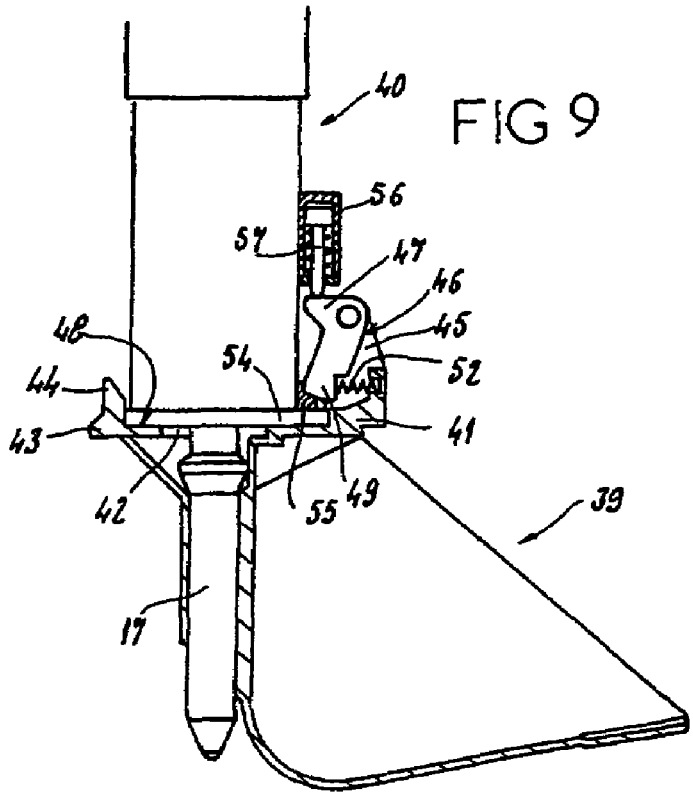
FIG. 9 is a cross-sectional view of an attachment according to a fourth embodiment of the invention fixed to a rock breaker.

FIG. 9 shows a bucket 39 fitted onto a rock breaker 40.

The bucket 39 comprises a horizontal socket 41 which extends in prolongation of the top wall 3 toward the back of the bucket 39 and features an opening 42. This socket 41 differs from the socket 6 of the bucket 1 by the fact that it comprises a partial peripheral edge 43, open in front, which defines a contact surface 48 intended for receiving the rock breaker 40. Positioning teeth 44 are provided at regular intervals along the edge 43.

The front of the socket 41 comprises, on the one hand, a lug 45, on which a pivoting lock-bolt 46 with an orthogonal return 47 is mounted and, on the other hand, a heel 49 formed such that it provides a sufficient clearance to allow rotation of the lock-bolt 46. A spring 52 connects the heel 49 to the socket 41 such that the latter is automatically thrown into its locked position.

The rock breaker 40 is of essentially circular cross section and has an end 54, to which a tool 17 is connected. A bearing pad 55 is fixed to the outside of the rock breaker 40 at the end 54 such that it is directed toward the front of the bucket 39, when the latter is connected. A pressure cylinder 56, from which a stem 57 extends, is fixed above the bearing pad 55. This pressure cylinder 56 is fixed high enough to ensure the stem 57 can press on the return 47 of the lock-bolt 46, when the bucket is mounted.

The spring 52 pushes back the lock-bolt 46 into the locked position before the bucket 39 is installed on the rock breaker 40. The stem 57 retracts into the pressure cylinder.

To connect the bucket 39, the perforating tool 17 is inserted into the tube 7 until, on the one hand, the end 54 is in contact with the bearing surface 44 inside the edge 43 and, on the other hand, the bearing pad 55 is facing the lock-bolt 46. During insertion, the end 54 of the rock-breaker 40 returns, through its bearing pad 55, the lock-bolt 46 toward its unlocked position, acting against the spring 52 associated with it. This results in the end 54 of the rock-breaker 40 being gripped between the lock-bolt 46, which bears on the bearing pad 55, and the back part of the edge 43.

To remove the bucket 39, the pressure cylinder 56 should be actuated in a stem extension direction such that it is caused to press on the return 47 of the lock-bolt 46. In doing this, the latter pivots in the trigonometrical direction toward its unlocked position, in which it no longer presses the rock-breaker 40 against the edge 43. It is then possible to extract the rock-breaker 40 and the perforating tool 17 from the edge 43 and the tube 7 respectively to remove the bucket.

Figure 11:
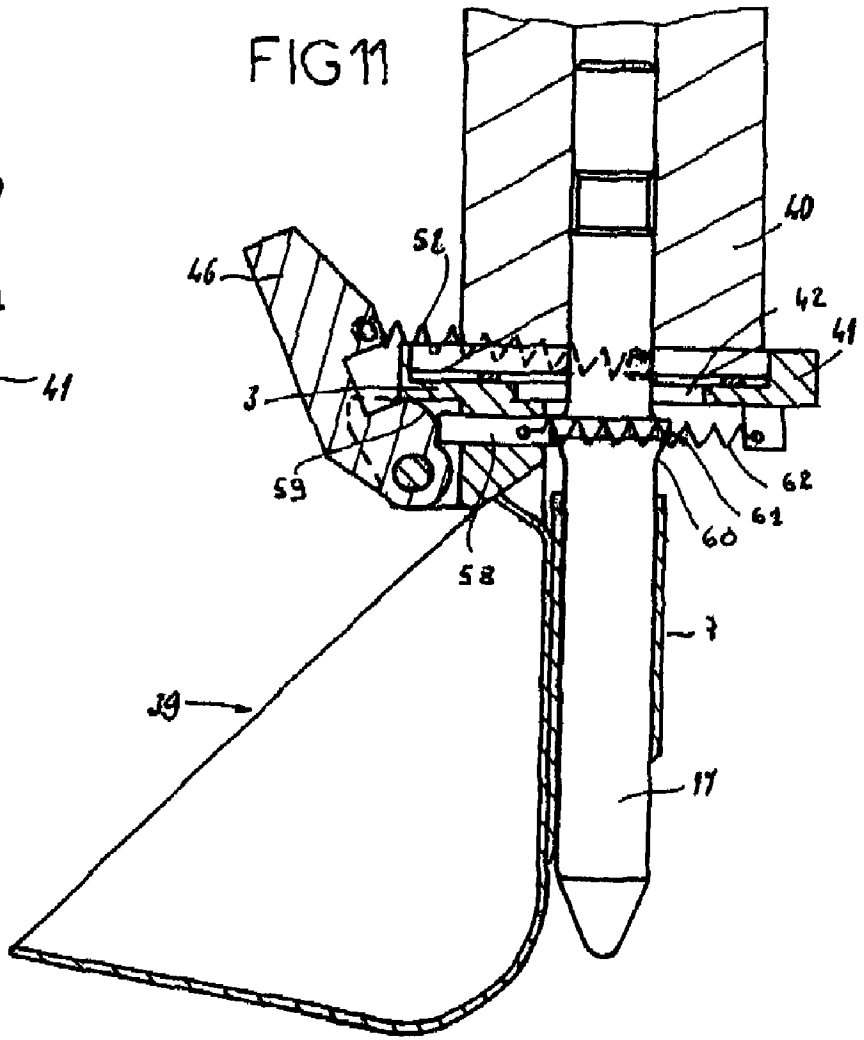
FIGS. 10 and 11 represent longitudinal cross sections through an alternative to the device in FIG. 9.
Figure 10:
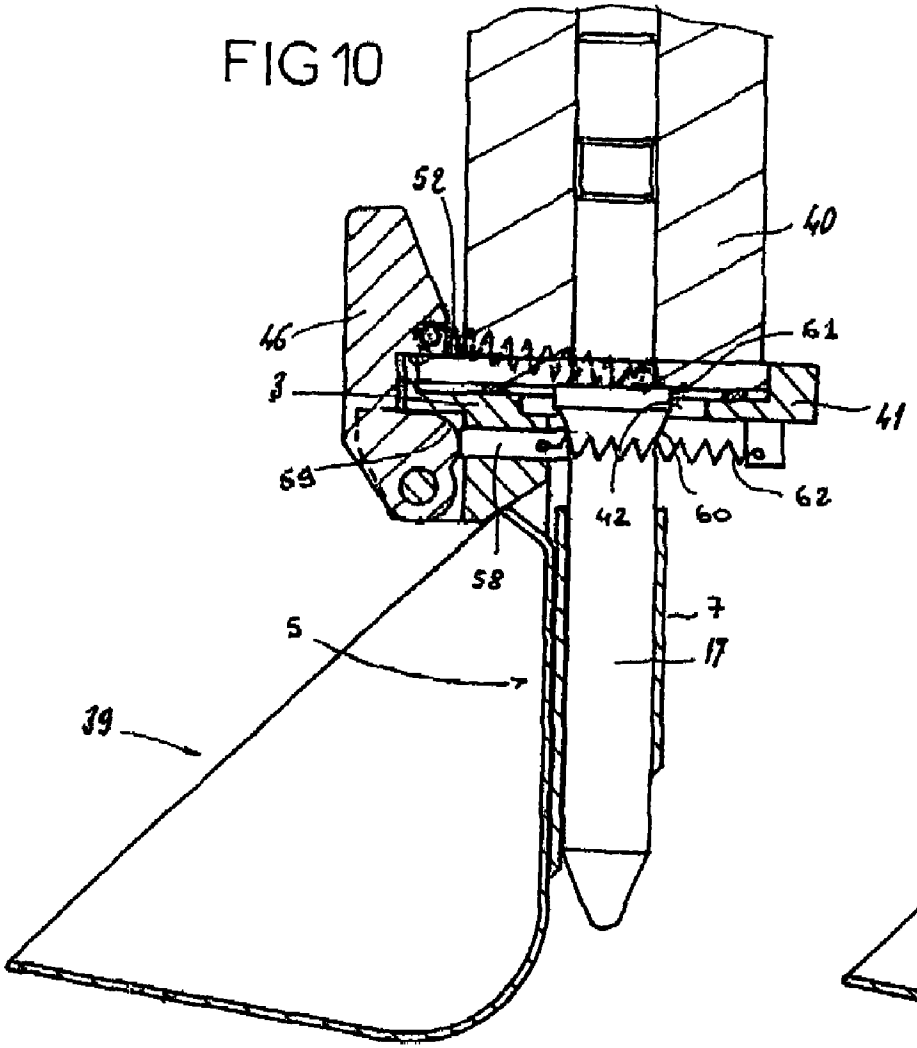

FIGS. 10 and 11 represent an alternative to the device in FIG. 9, in which the same components are designated by the same references as before. This form of embodiment differs from the former by the attachment unlocking mechanism. This mechanism comprises a plate 58 mounted to slide with respect to the top wall 3 of the attachment, perpendicularly to the axis of the tool 17. One end of this plate 58 bears on a cam-shaped surface 59 of the lock-bolt 46 and its opposite end bears against an inclined surface 60 of a collar 61 of the tool 17. This plate is subjected to the action of a tension spring 62, which acts on it in a displacement direction toward the collar. In the unlocked position, represented in FIG. 10, the plate 58 bears on the underside of the collar 61.

To unlock and disconnect the attachment, the rock breaker should be operated, even sporadically, to displace the tool 17 downwards, a movement during which the inclined surface 60 of the collar 61 pushes the plate 58, which acts on the cam 59 to throw the lock-bolt 46 outwards, as shown in FIG. 11, and to release the bottom wall 54 of the rock breaker. Unlocking is thereby performed using the inherent energy of the rock breaker and without the need for manual intervention by the operator, who can remain at his control station.

Whilst the invention has been described in conjunction with specific execution examples, it is obvious that it is in no way limited and includes all technical equivalents of the described means as well as their combinations, if these fall within the scope of the invention.

The invention claimed is:

1. A bucket, claw, scraper blade or compacting-type attachment intended to be fitted to one end of a powered rock breaker equipped with a tool, the attachment comprising, a positioning portion that correctly positions the attachment with respect to the rock breaker and the tool, a fixing device for temporarily fixing the attachment to the end of the rock breaker, wherein the fixing device allows the attachment to be removable without dismantling the tool, and a back wall having an external face being fitted with a guide tube device for engaging with the tool.

2. The attachment according to claim 1, wherein the guide tube has an insertion end, the insertion end being widened into the shape of a funnel.

3. The attachment according to claim 2, wherein the insertion end of the guide tube is surmounted by an open socket, the open socket being fitted with at least one positioning pin.

4. The attachment according to claim 1, wherein the guide tube comprises two orifices facing each other, the two orifices allowing a fixing key to be engaged in a recess in, or a hole through, the tool.

5. The attachment according to claim 1, wherein the fixing device comprises at least two fixing lugs being mounted on a top wall of the attachment, each fixing lug incorporating an eye through which a retaining bar can be inserted and fixed, the retaining bar passing over a collar or similar belonging to the rock breaker body.

6. The attachment according to claim 1, further comprising a top wall surmounted by a lock-bolt, wherein the lock-bolt can pass alternately from a locked position, locking a part of the rock breaker body, to an unlocked position releasing the body.

7. The attachment according to claim 6, further comprising elastic means that automatically places the lock-bolt in the locked position, and a pressure cylinder acting on the lock-bolt to throw the lock-bolt into the open position.

8. The attachment according to claim 6, further comprising elastic means that automatically places the lock-bolt in the locked position, and a release mechanism comprising a plate, the plate being slidably mounted with respect to the top wall of the attachment and transversely mounted to the axis of the tool, wherein, in the locked position of the tool, one end of the plate bears on a cam-shaped surface of the lock-bolt and the other end of the plate bears on an inclined surface of a collar of the tool, and that during movement of the tool, the collar displaces the plate toward the lock-bolt, causing the lock-bolt to pivot in an opening direction.

9. The attachment according to claim 1, further comprising a rotational locking means for rotational locking of the attachment onto the rock breaker, the rotational locking means comprising a noncircular-shaped socket that interlocks with a complementary surface of a bottom end of the rock breaker body.

10. A mobile machine comprising a rock breaker fitted with the attachment according to claim 1.

* * * * *